United States Patent [19]

Couper

[11] Patent Number: 5,031,895

[45] Date of Patent: Jul. 16, 1991

[54] SELF-COMPENSATING DOCUMENT DRIVE SYSTEM

[75] Inventor: John Couper, West Lothian, Scotland

[73] Assignee: Unisys Corporation, Blue Bell, Pa.

[21] Appl. No.: 494,988

[22] Filed: Mar. 16, 1990

[30] Foreign Application Priority Data

Mar. 29, 1989 [GB] United Kingdom ..... 8907111

[51] Int. Cl.[5] ..... B65H 5/06

[52] U.S. Cl. ..... 271/251; 271/274

[58] Field of Search ..... 271/251, 273, 274, 250

[56] References Cited

U.S. PATENT DOCUMENTS 3,630,518 12/1971 Street ..... 271/251
4,438,918 3/1984 Ito ..... 271/251
4,669,719 6/1987 Fratangelo ..... 271/251

FOREIGN PATENT DOCUMENTS 2059398 4/1981 United Kingdom .

*Primary Examiner*—Richard A. Schacher
*Attorney, Agent, or Firm*—Whitham & Marhoefer

[57] ABSTRACT

The invention relates to a document drive system in which the documents are transported along a track and are also urged towards the base of the track so that they are correctly oriented. The documents are driven by a drive roller 14 cooperating with a ball idler assembly resiliently mounted so that the document is gripped between a ball 33 and the drive roller 14. The axis of rotation of the drive roller is inclined with respect to the track so that a downward force is applied to the document. So long as the document can be moved towards the track, the ball 33 rotates about an axis which is parallel to the axis of rotation of the drive roller, but once the document is aligned with its lower edge in contact with the base of the track, the ball rotates about an axis perpendicular to the base of the track.

5 Claims, 3 Drawing Sheets

SELF-COMPENSATING DOCUMENT DRIVE SYSTEM

BACKGROUND OF THE INVENTION

Field of the Invention

This invention relates to document transport systems. Such systems are used in machines of many different types for transporting documents along a track, for example for automatic processing of the documents. One particular machine involving the use of a document transport system is a check encoding machine for the automatic processing of bankers' checks.

In check encoding machines, as well as in many other machines using document transport systems, it is desirable to maintain one edge of the document in contact with a reference surface of the track while the document is being moved along the track. One particular transport system includes a drive roller engaging one surface of the document; idler means engaging the opposite surface of the document and resilient means urging the drive roller and the idler means towards each other to grip the document therebetween. In such a system, the axis of rotation of the drive wheel is normally perpendicular to the reference surface and it is known to use an idler roller as the idler means and to arrange the axis of rotation of the idler roller at an angle to the axis of rotation of the drive roller so that the idler roller applies the desired force urging the said edge of the document towards the reference surface of the track. One such system which enables documents to be moved in both directions along the track is described in GB-A-2 171 395. A somewhat similar system is also disclosed in IBM Technical Disclosure Bulletin, Volume 26, No. 7a, December 1983, page 3133.

In another system, the axis of rotation of the drive roller is displaced from the perpendicular to the reference surface so that the drive roller itself applies not only the force required to move the document along the track, but also the force required to urge the document towards the reference surface of the track. In such a system the axis of rotation of the idler roller may be parallel to the axis of rotation of the drive roller, but is preferably capable of being moved from a position in which it is parallel to the axis of the drive roller to a position in which it is perpendicular to the surface reference. In an arrangement in which the axis of the idler roller is movable in this way, the direction of the force applied to the document by the idler roller is also movable so that the force will have a component directed towards the reference surface while the edge of the document is spaced from the reference surface, but this component will be eliminated when the edge of the document comes into contact with the reference surface. Such an arrangement therefore reduces the risk of buckling of the document.

A system of the kind described in the preceding paragraph is relatively complicated and therefore expensive, and it is an object of the present invention to provide a system which has a similar effect to that described, but which is simpler and therefore less expensive.

SUMMARY OF THE INVENTION

Thus, the invention relates to a system for transporting documents along a track with one edge of each document in contact with a reference surface of the track, said system comprising a drive roller engaging one surface of the document, idler means engaging the opposite surface of the document, and resilient means urging the drive roller and the idler means towards each other to grip the document therebetween.

The invention is characterized in that the axis of rotation of the drive roller is inclined relative to the track so that it applies a force to the document having a first component directed along the track and a second component directed towards said reference surface, and in that said idler means comprises a spherical member universally mounted so that it tends to rotate about an axis parallel to the axis of rotation of the drive roller so long as said one edge of the document is spaced from said reference surface whereas it tends to rotate about an axis perpendicular to said reference surface while said edge is in contact with said reference surface.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
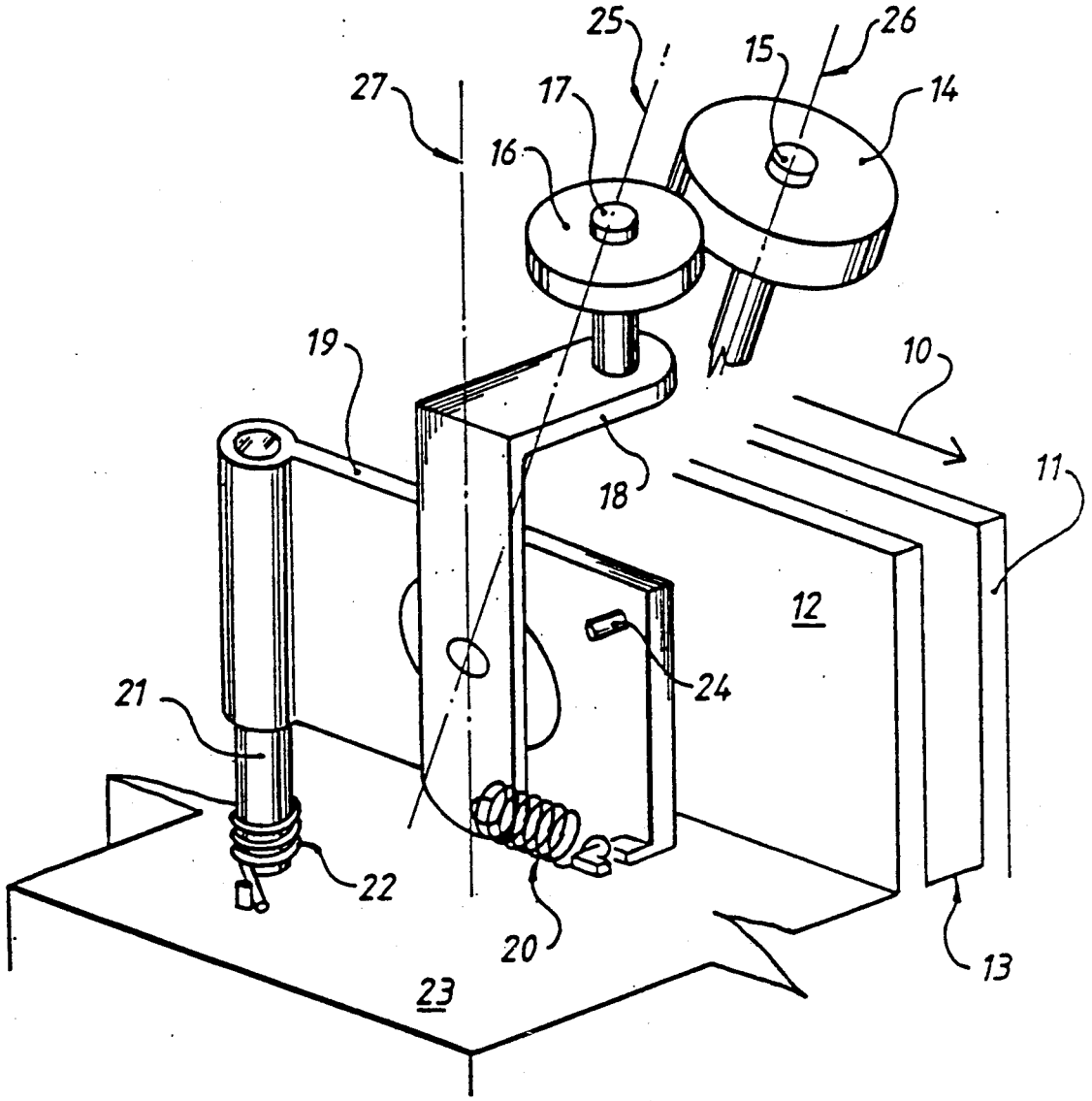
Fig 1. (PRIOR ART)
FIG. 1 is a perspective view of a part of a known document transport system.

In the arrangement illustrated in FIG. 1 a document is urged in the direction of an arrow 10 between two walls 11 and 12 of a document track. The system is designed to urge the document not only in the direction of the arrow 10, but also towards the base 13 of the document track so that the document will be correctly oriented when it reaches a processing station.

For this purpose, the document is driven by a drive roller 14, the axis 15 of which is inclined at an angle to the perpendicular to the plane of the base 13 of the document track. The document passes between the periphery of the drive roller 14 and the periphery of an idler roller 16. The roller 16 is rotatable on an axle 17 which is fixed in a bracket 18 which is itself rotatably mounted on a support 19. The bracket 18 is urged in an anticlockwise direction as seen in FIG. 1, by means of a return spring 20. The support 19 is rotatably mounted on a shaft 21 secured in a baseplate 23 on which the document track is also mounted.

The support 19 is rotated on the shaft 21 in an anticlockwise direction as seen from above by means of a torsion spring 22.

When a document enters the pinch between the rollers 14 and 16, the roller 14 applies a force as already mentioned, tending to move the document both in the direction of the arrow 10 and also downwardly towards the base 13 of the document track. This inclined movement of the document causes the roller 16 to rotate in an anticlockwise direction and also causes the bracket 18 to rotate in a clockwise direction against the action of the spring 20 until it reaches the stop 24. When the bracket is brought up against the stop 24 the axis of rotation of the roller 16 is parallel to the axis of rotation of the drive roller 14, as indicated by the broken lines 25 and 26, respectively. When the document reaches the track base it resists further downward movement due to its buckling strength and also to the support provided for it by the walls 11 and 12 of the document track. As a result there is no longer a force tending to rotate the bracket 18 in a clockwise direction, and the spring 20 returns the bracket to the vertical position shown in the drawing. As a result the axis of rotation of the idler roller 16 is now perpendicular to the base of the document track, as indicated by the broken line 27, and the circumferential movement of the idler roller is in the same direction as the movement of the document. Thus, although there is still some scrubbing between the drive roller and the document, there is no scrubbing between the idler roller and the document. This also reduces the downward crushing force on the document which could prevent the document from traveling correctly along the document track.

The arrangement in FIG. 1 suffers from a number of disadvantages mainly concerned with its complexity. Reliability tends to be low because of the large number of active components. In particular, the idler assembly illustrated involves the use of two springs and three bearing surfaces. A further disadvantage of this system is its high cost because of the large number of precision components. Also connected with the number of precision components is the complexity of manufacture.

The invention avoids the disadvantages of the arrangement shown in FIG. 1 by replacing the complex idler assembly shown in that Figure by a simple self-compensating idler arrangement. In the arrangement illustrated in FIGS. 2 and 3 the document is still driven by a drive roller mounted on a rotatable drive shaft 15. However, the idler assembly of FIG. 1 is replaced by a ball idler assembly. This assembly comprises a ball idler housing 30 which is rotatably mounted on the baseplate 31 by means of a pillar 32. Contained within the housing 30 is an idler ball 33 which is urged against the periphery of the drive roller 14 by means of a torsion spring 34. The ball 33 is retained in the housing 30 by the action of the spring 34.

The document is again urged both along the document track and downwardly towards the base of the document track by means of the inclined axis of rotation of the driver roller. The ball 33 is urged against the circumference of the drive roller by means of the spring 34 and the document passes through the pinch formed between the surfaces of the roller and the ball. The ball 33 rotates about an axis which is parallel to the axis of the drive roller shaft until, as in the arrangement of FIG. 1, the document reaches the base of the document track and therefore resists further downward movement. When this occurs, the ball 33 self-compensates and rotates about an axis perpendicular to the base of the document track. Thus, once again the design of the system avoids the vertical crushing component on the document.

Figure 2:
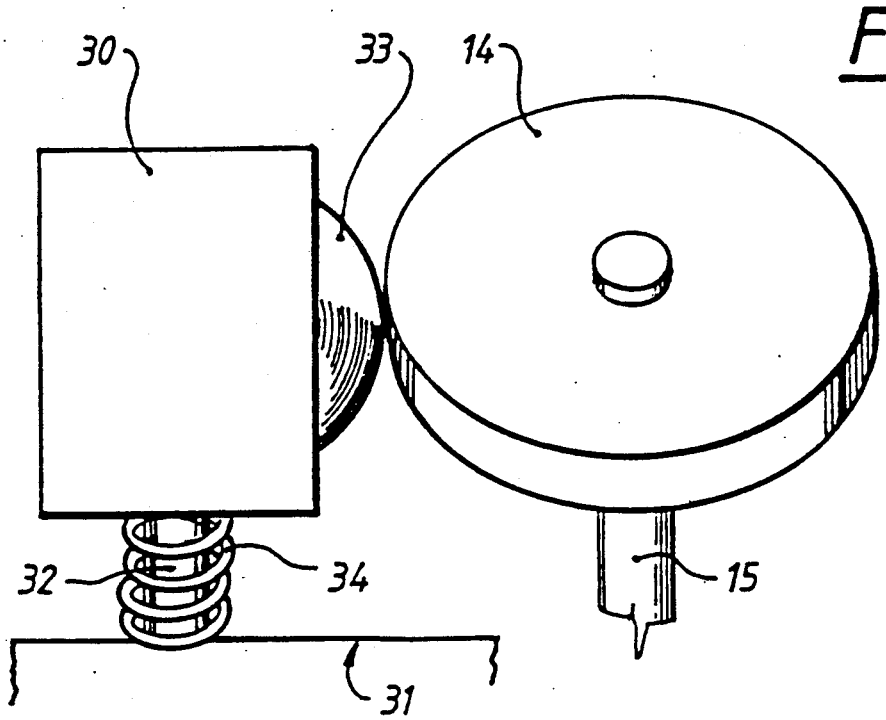
FIG. 2 is a front elevation looking in the direction of the document track in a transportation system in accordance with the invention.
Figure 3:
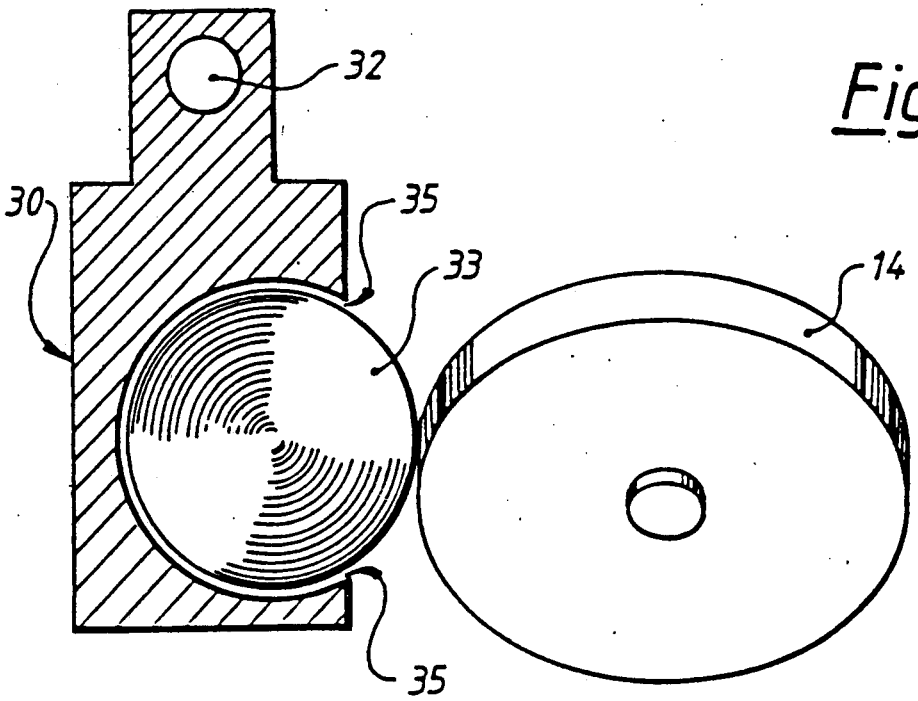
FIG. 3 is a plan view, partly in section, of the system shown in FIG. 2.

It will be understood that the arrangement shown in FIGS. 2 and 3 is simpler than that shown in FIG. 1, and it has been found that it is more reliable since the idler assembly involves the use of only a single spring and two bearing surfaces. The cost of this arrangement is less than that of the arrangement of FIG. 1 because of the greatly reduced number of parts. Similarly the apparatus is easier to manufacture both because of the reduced number of parts and also because the parts are less intricate.

The arrangement shown in FIGS. 2 and 3 provides greater flexibility because it is self-compensating and can therefore be used with drive rollers set at different angles, whereas the arrangement of FIG. 1 requires a different design according to the angle of inclination of the drive roller.

Figure 4:
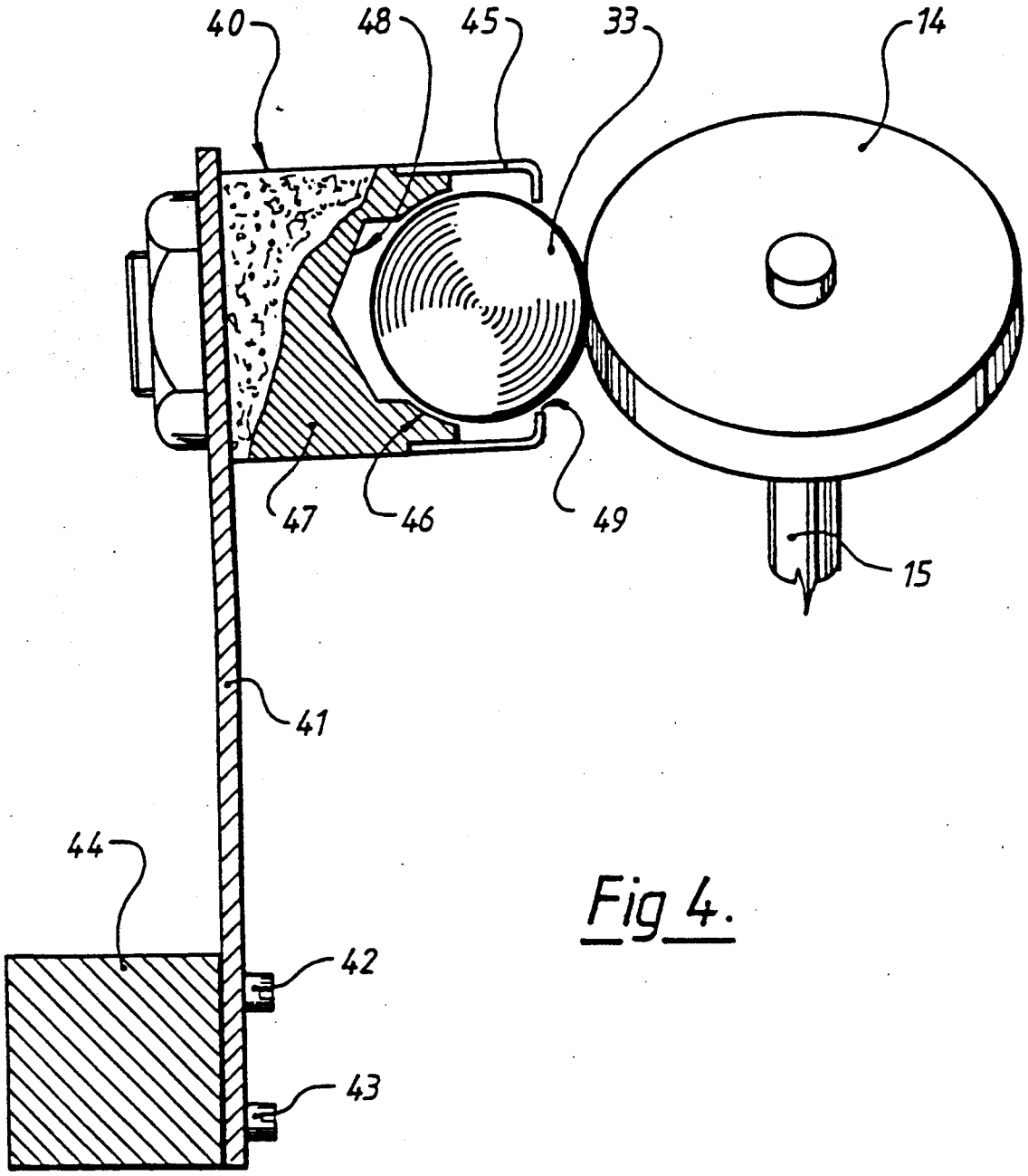
FIG. 4 illustrates an alternative embodiment of the present invention.

The principle of operation of the arrangement shown in FIG. 4 is similar to that of the arrangement shown in FIGS. 2 and 3. Once again the design provides a drive roller 14 rotating on a drive shaft 15 disposed so that the driver roller applies a force to a document urging both in the direction of transport and also towards the base of the document track. Further, the document again passes between the periphery of the drive roller 14 and a ball 33. In this case, however, the ball is retained in a housing 40 which is itself mounted on a leaf spring 41 secured by means of bolts 42 and 43 to a support 44 mounted on the baseplate of the machine.

The ball 33 is retained in the housing 40 by means of a steel cage 45 and the ball rotates against a bearing surface 46 formed in a block of low friction material 47. The interior of the block is cut away as shown at 48 to reduce the total area of bearing contact. As can be seen from FIG. 4, the cage 45 is arranged so that the edges 49 are clear of the ball when the ball is in contact with the periphery of the drive roller 14.

Preferably the ball 33 consists of steel and the block 47 consists of, or is coated with, polytetrafluoroethene. Similar considerations apply to the arrangements shown in FIGS. 2 and 3 in which the interior of the housing 30 is preferably coated with polytetrafluoroethene. In any case, the coefficient of friction between the ball 33 and the document is preferably greater than the coefficient of friction between the periphery of the drive roller 14 and the document. This minimizes the buckling effect produced by the scrubbing of the drive roller against the document once the document has aligned itself with its lowermost edge on the base of the document path.

It is to be understood that the walls 11 and 12 of the document path as shown in FIG. 1 need not be vertical with the base 13 of the document path horizontal. Thus, for example, the walls 11 and 12 could be horizontal and the base 13 could be vertical. Accordingly, references hereinbefore to downward movement of the document towards the base 13 include any movement towards said base even if it is not horizontal.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A system for transporting documents along a track with one edge of each document in contact with a reference surface of the track, said system comprising:

a drive roller engaging one surface of the document, said drive roller having an axis of rotation orientated relative to the track so that it applies a force to the document having a first component directed along the track and a second component directed toward said reference surface;

a spherical idler mounted in a housing which carries said spherical idler and allows universal rotation of said idler with a surface of said idler in contact with said drive roller;

said housing including a bearing surface of low-friction material and a cage retaining said spherical idler within said housing; said spherical idler being movable with respect to said cage so that said cage is out of contact with said spherical idler when said spherical idler is urged against said drive roller; and resilient means for continuously urging said housing toward said drive.

2. A system according to claim 1, wherein the housing is rotatably mounted by means of a pillar which is offset from the center of the spherical member and wherein a torsion spring tends to rotate said housing about the axis of said pillar so that the spherical member is urged against the driver roller.

3. A system according to claim 1, wherein the housing is mounted on a leaf spring which urges the spherical member towards the drive roller.

4. A system according to claim 1, wherein said bearing surface consists of, or is coated with, polytetrafluoroethene.

5. A system according to claim 1, wherein the coefficient of friction between the spherical member and the document is greater than the coefficient of friction between the document and the drive roller.

* * * * *